US005518435A

United States Patent [19]

Glickman

[11] Patent Number: 5,518,435

[45] **Date of Patent: * May 21, 1996**

[54] MOTOR INSTALLATION FOR CONSTRUCTION TOY SYSTEM

[75] Inventor: Joel I. Glickman, Huntingdon Valley, Pa.

[73] Assignee: Connector Set Limited Partnership, Hatfield, Pa.

[ * ] Notice: The portion of the term of this patent subsequent to Mar. 2, 2013, has been disclaimed.

[21] Appl. No.: 418,271

[22] Filed: Apr. 7, 1995

Related U.S. Application Data

[63] Continuation of Ser. No. 25,183, Mar. 2, 1993, Pat. No. 5,423,707, which is a continuation-in-part of Ser. No. 717,639, Jun. 19, 1991, Pat. No. 5,199,919, which is a continuation-in-part of Ser. No. 687,386, Apr. 18, 1991, Pat. No. 5,137,486, and Ser. No. 625,809, Dec. 11, 1990, Pat. No. 5,061,219.

[51] Int. Cl.[6] ..... A63H 33/00

[52] U.S. Cl. ..... 446/126; 446/129; 446/85

[58] Field of Search ..... 446/85, 105, 107, 446/120, 124, 125, 126

[56] References Cited

U.S. PATENT DOCUMENTS

| | | | |
|---|---|---|---|
| 1,915,835 | 6/1933 | Pajeau | 446/124 |
| 2,095,046 | 10/1937 | Wilner . | |
| 2,477,441 | 7/1949 | Cole . | |
| 2,545,131 | 3/1951 | Ayres . | |
| 2,692,443 | 10/1954 | Milligan . | |
| 3,172,666 | 3/1965 | Ryan . | |
| 3,193,293 | 7/1965 | Schaper . | |
| 3,589,060 | 6/1971 | Genin . | |
| 3,608,233 | 9/1971 | Aoki . | |
| 3,881,274 | 5/1975 | Kanda . | |
| 3,965,610 | 6/1976 | Den Ouden . | |
| 4,507,095 | 3/1985 | Lin . | |
| 5,061,219 | 10/1991 | Glickman . | |
| 5,137,486 | 4/1992 | Glickman . | |
| 5,194,031 | 3/1993 | Sahler . | |
| 5,199,919 | 4/1993 | Glickman . | |

FOREIGN PATENT DOCUMENTS

| | | |
|---|---|---|
| 293870 | 7/1928 | United Kingdom . |

OTHER PUBLICATIONS

Motorized Tinkertoy (one sheet) (Mar., 1966).

*Primary Examiner*—Sam Rimell

*Attorney, Agent, or Firm*—Schweitzer Cornman & Gross

[57] ABSTRACT

A construction toy system is provided, in which a coherent structure can be assembled from a series of rod-like struts and hub-like connectors, wherein the struts have specially contoured ends engageable by lateral, snap-in assembly with pairs of contoured gripping arms on the connector elements. Upon snap-in assembly, the struts are effectively rigidly joined with the connectors. A motor mount is provided, to which is fixed an electric drive motor. The motor mount includes spaced-apart elements, preferably struts received in guide tubes rigidly joined to the platform-like element, by which the motor mount may be secured by snap-in engagement to connector elements, to become part of the coherent structure. Spur gears and pinions can be rotatably supported in the structure using struts and connector elements providing a gear train for converting the output of the motor to driving an element of the construction toy system.

5 Claims, 5 Drawing Sheets

FIG. 4
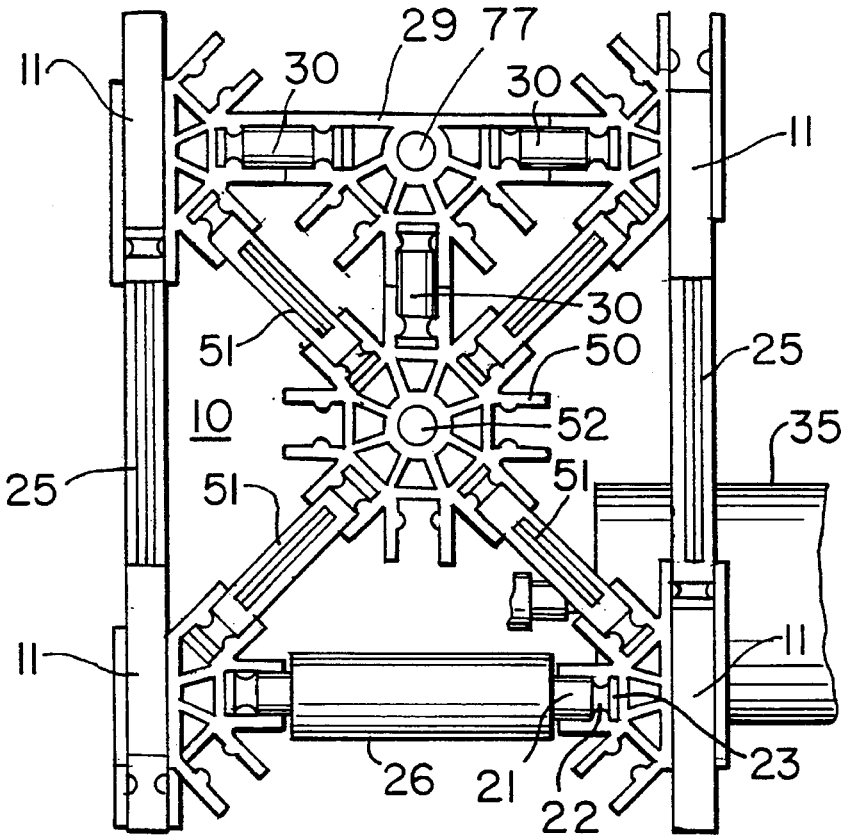
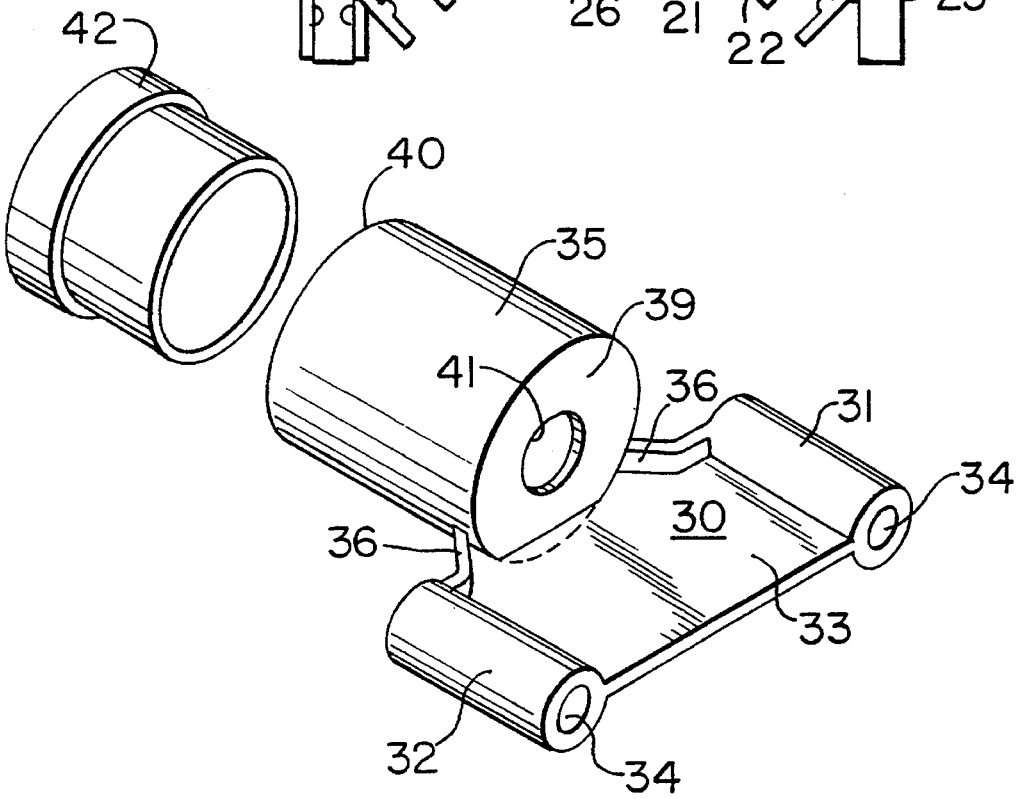
FIG. 5

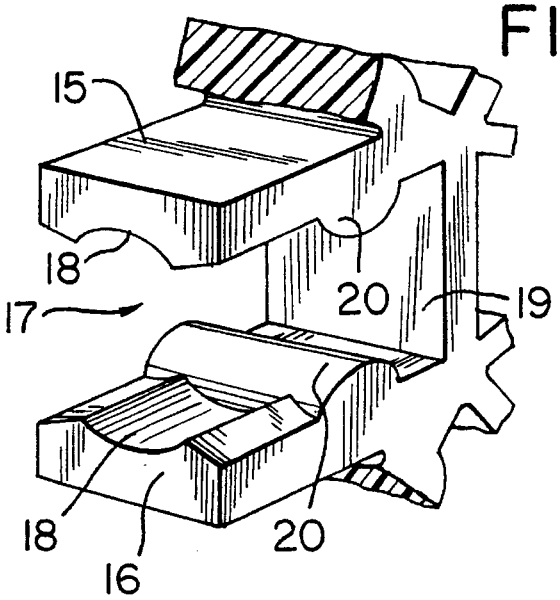
FIG. 6
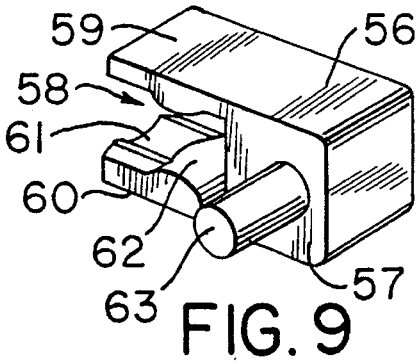
FIG. 9
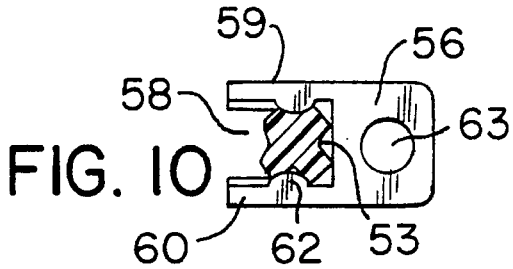
FIG. 10
FIG. 7
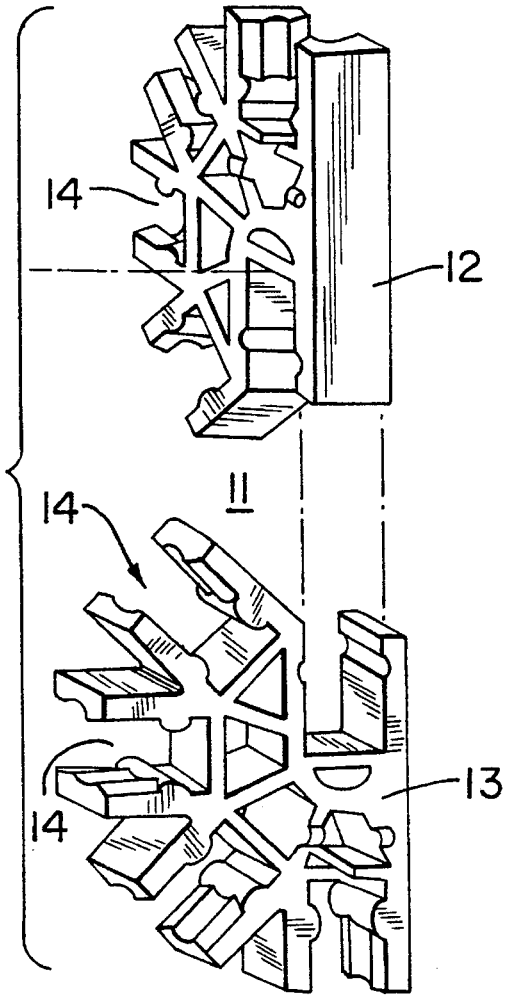
FIG. 8
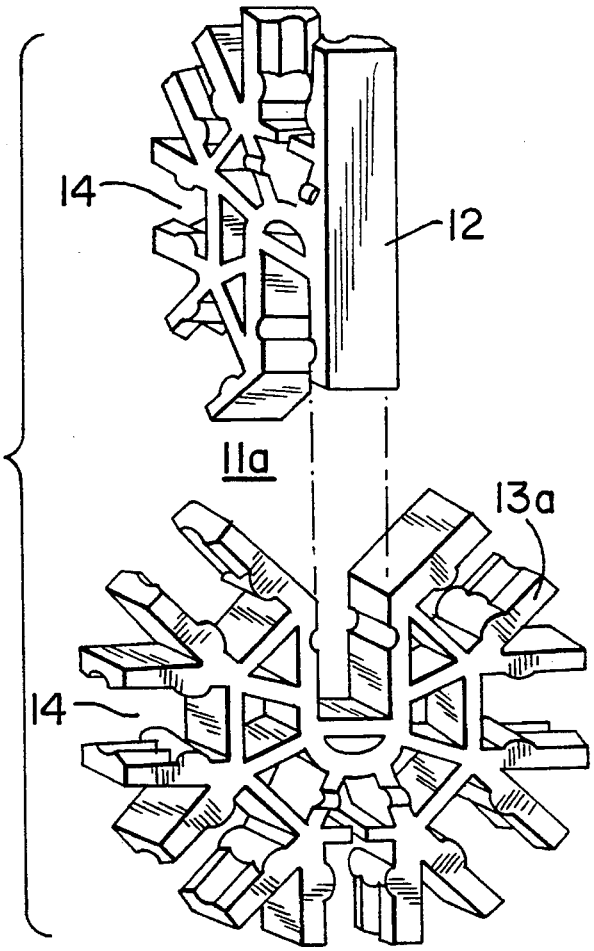

MOTOR INSTALLATION FOR CONSTRUCTION TOY SYSTEM

RELATED APPLICATIONS

This application is a continuation of my parent application Ser. No. 025,183, filed Mar. 2, 1993, now U.S. Pat. No. 5,423,707. That parent application was a continuation-in-part of my application Ser. No. 717,639, filed Jun. 19, 1991, now U.S. Pat. No. 5,199,919, granted Apr. 6, 1993. The application is turn a continuation-in-part of my earlier application Ser. No. 687,386, filed Apr. 18, 1991, now U.S. Pat. No. 5,137,486, granted Aug. 11, 1992 and of my earlier U.S. application Ser. No. 625,809, filed Dec. 11, 1990, now U.S. Pat. No. 5,061,219, granted Oct. 29, 1991. The disclosures of said patents and said copending application are incorporated herein by reference.

BACKGROUND AND SUMMARY OF THE INVENTION

The above mentioned patents disclose a novel form of construction toy system which is comprised of a plurality of rod-like strut elements and a plurality of hub-like connector elements. While reference should be made to the prior patent documents themselves for full details of the disclosure and claim coverage thereof, the earlier documents deal generally with a novel form of strut and connector which are configured to allow lateral, snap-in assembly of the strut ends into sockets formed in the connector elements by pairs of gripping arms. The ends of the strut elements, and the gripping arms of the connector elements are contoured such that, when the parts are snapped together, the struts are gripped and held firmly against both axial and lateral movement in relation to the connector elements. This unique configuration of parts, as explained in the above mentioned patents, enables the construction of complex, coherent skeletal structures.

Many of the structures possible to assemble using the struts and connectors of my earlier patents can involve moving parts. By way of example only, it is possible to construct ferris wheels, carrousels, elevators, cranes and the like, all providing for driven motion of certain components. In accordance with the present invention, a unique and inexpensive and highly simplified motor mount structure can be incorporated into a coherent structure, assembled from struts and connector elements of my prior patents, to in effect form part of such structures and enabling convenient, motor controlled operation of movable elements of such structures. In a particularly advantageous embodiment of the invention, a motor mount unit is provided, desirably formed as a unitary element of injection molded plastic, which includes a pair of spaced-apart, parallel and rigidly connected guide members integrally joined with a molded plastic motor-receiving housing. The spaced-apart guide members are of tubular form, and each is adapted to closely receive a strut element. The strut elements are of such a length that end portions thereof project beyond the opposite ends of the tubular guide members, so that the projecting end portions are available for lateral snap-in engagement with adjacent connector elements. This simple arrangement enables the motor mount device to be easily incorporated into the coherent structural assembly, being supported firmly at four locations, and being accurately located within the structure.

Pursuant to the invention, the lateral spacing between the respective tubular guide members corresponds precisely to the center-to-center spacing of a pair of connector elements joined by a strut element of standard length oriented transversely of the axis of the tubular guide members and engaging connector element assemblies to which the struts, supporting the motor mount, are engaged. Desirably, although not necessarily, the length of the tubular guide members is closely correlated with the length of one of the standard length of strut element, such that minimal end portions of the struts project from opposite ends of the guide members. When the struts are engaged and gripped by connector elements, the presence of the connector elements serves to closely confine the motor mount against axial movement along the struts by which it is supported.

Associated with the novel motor mount arrangement is a series of gears, arranged to be driven by an electric motor carried in the motor mount, and adapted to be supported by standard strut elements, utilized throughout the construction toy system, and by the use of standard connector elements used throughout the construction toy system. The gears are adapted to be mounted for free rotation on a strut element, but are fixed for rotation with the struts by means of special drive blocks, known from my prior patents, which grip non-circular portions of the strut elements and are provided with laterally projecting lugs, received in correspondingly located recesses within the gears. Utilizing a standard pinion and gear set, it is possible to construct, within skeletal framework of the construction toy, gear drives of a variety of speed and mechanical advantage combinations, to provide for motor driven actuation of a wide variety of constructed devices.

For a more complete understanding of the above and other features and advantages of the invention, reference should be made to the following detailed description of preferred embodiments of the invention and to the accompanying drawings.

DESCRIPTION OF THE DRAWINGS

FIG. 4 is an end elevational view of the structure of FIG. 1.

FIG. 5 is an exploded perspective view showing the new motor mount structure and the manner in which it is combined with strut elements for incorporation in the structure of FIG. 4.

FIG. 6 is an enlarged, fragmentary perspective view illustrating details of a connector element incorporated in the structure of FIG. 1.

FIGS. 7 and 8 are exploded perspective views of specific forms of connector elements which may usefully be employed in the structure of FIG. 1.

FIG. 9 is a perspective view of a drive block element for engaging a gear or other rotary element for fixed rotation with a strut element.

FIG. 10 is an elevational view of the drive block of FIG. 9, illustrating the manner of its engagement with a strut.

DESCRIPTION OF PREFERRED EMBODIMENTS

Figure 1:
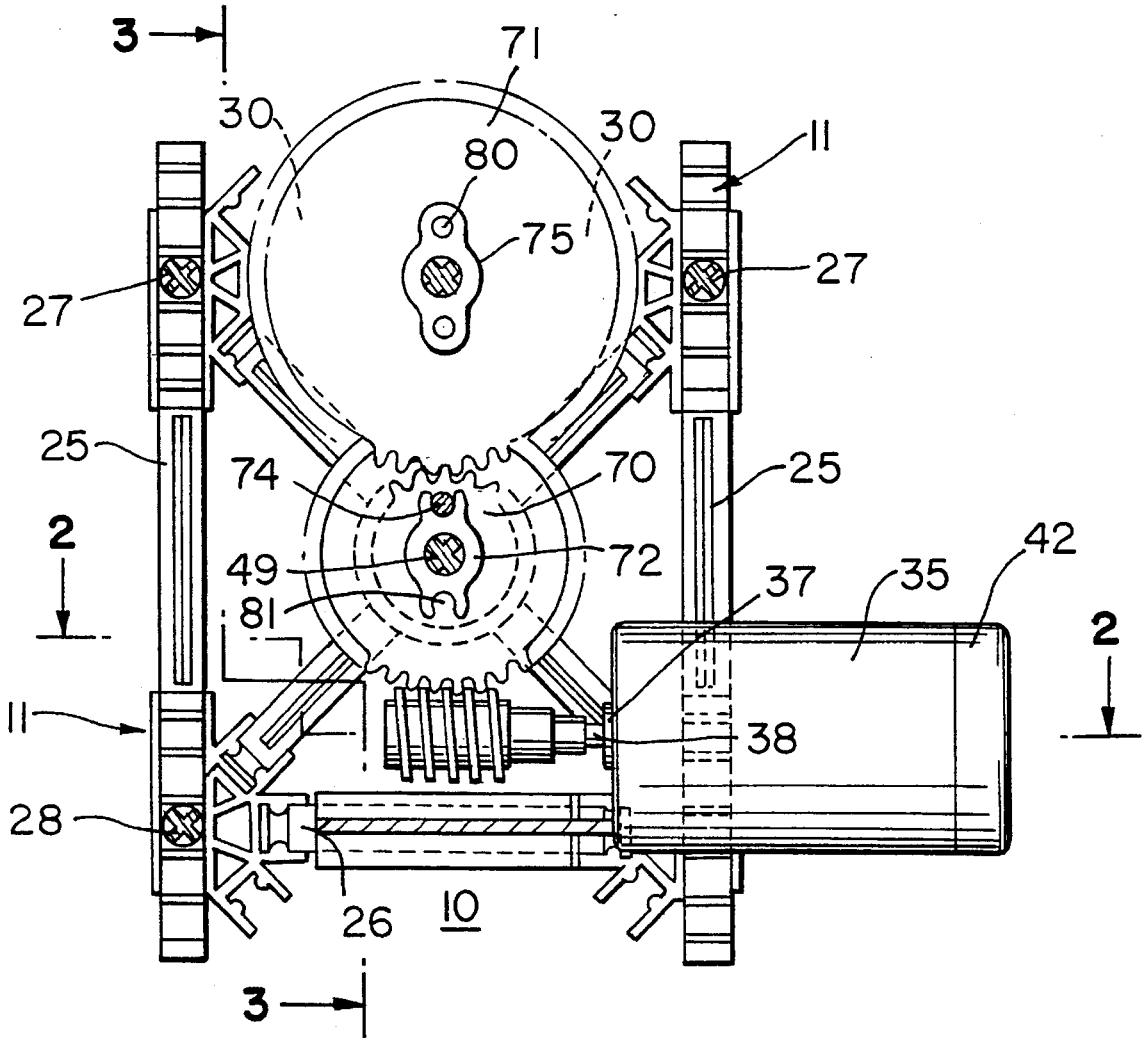
FIG. 1 is a side elevational view, partly in section, of a coherent structure, assembled with struts and connector elements as disclosed in my prior patents and incorporating a novel motor mount and gear drive arrangement according to the present invention.

Referring now to the drawing, FIGS. 1–4 illustrate a coherent skeletal structure assembled from a plurality of strut and connector elements of the type described in my above patents. It is to be understood that the specific structure shown in the drawing is only for purposes of illustrating the principles of the invention, and the structure may in practice take any one of a variety of forms, of various levels of simplicity and complexity. The illustrated structure 10 is of generally rectangular configuration and is provided at each of eight corners with connector assemblies 11 (or 11*a*) which, for purposes of illustration, may be of the type shown in FIG. 7 (or FIG. 8), wherein each of two connector elements 12, 13 (or 12, 13*a*) are joined together in nested relation and at right angles providing sockets, generally designated by the reference numeral 14, for the reception and engagement of structural elements extending in two right angularly related planes.

The individual connector elements are provided with radially disposed pairs of gripping arms 15, 16 forming strut-receiving sockets 17, as shown in FIG. 6. Outer portions of the gripping arms are formed with axially disposed grooves 18. Adjacent to but spaced from an inner end wall 19 of the socket are transversely disposed ribs 20, which project into the recess space and extend transverse to the axis defined by the grooves 18.

Strut elements employed in the construction toy system are of a standard configuration, but are provided in graduated lengths according to a predetermined length progression such that each next larger strut length is appropriate to enable that strut to serve as the hypotenuse for an isosceles right triangle constructed utilizing struts of the next-smaller length as the base elements. At each end, the struts are formed with a region 21 (see FIG. 4) of cylindrical contour, an annular groove 22, and an end flange 23. The end portion of a strut element can be joined with a connector element by a lateral snap-in assembly motion. The connector elements desirably are injection molded of structural plastic material, such that the gripping arms 15, 16 may deflect outwardly to accommodate the lateral snap-in assembly, after which the gripping arms snugly engage and grip the end of the strut, with the strut being held firmly in axial alignment with the socket 17 by the arcuate grooves 18, and being restrained against axial movement by the transverse ribs 20.

In the illustrative structure of FIGS. 1–4, the several connector assemblies 11, located at the corners of the structure, are joined top to bottom by vertical struts 25 at each of the four corners. Spaced-apart longitudinally extending struts 26 join connector assemblies front to back at the bottom of the structure, and transversely extending struts 27 join connector assemblies side to side at the top of the structure and also (strut 28) at the bottom of the structure, at one end.

For reasons that will become evident, the upper connector assemblies 11 are connected in a longitudinal direction not by a single unitary strut element but by an assembly comprising a centrally positioned connector element 29 and short strut elements 30. The combined length of the struts 30, and the central connector element 29 with which they are engaged, is identical to the length of the lower, longitudinally disposed struts 26.

Pursuant to the invention, a novel and unique form of motor mount is provided, for incorporation in a coherent structure such as shown in FIGS. 1–4, enabling a small electric drive motor to be incorporated into the system for operating movable elements. In accordance with the invention, the motor mount arrangement, shown best in FIGS. 1, 2 and 5, comprises a unitary plastic injection molded main housing part 30, which comprises a pair of spaced-apart, preferably tubular guide members 31, 32. These are rigidly joined by a connecting structure 33 which, in the illustrated embodiment, may be in the form of a platform-like web. The guide members 31, 32 are spaced apart a distance equal to the lateral spacing between struts 26, extending longitudinally between connector assemblies 11 at the lower corners of the coherent structure (see FIG. 2). The guide members are provided with internal tubular passages 34 adapted to closely receive the strut elements 26, which are configured to have a substantially uniform circular cross sectional envelope throughout their length.

To advantage, the length of the tubular guide members 31, 32 is related to the length of a selected-size strut 26 received within the tubular passages 34, such that only short, predetermined end portions of the struts 26 project from the opposite ends of the guide member. When the ends of the struts 26 are snapped in place in the lower connector assemblies 11, the end surfaces of the tubular guide members abut or lie closely adjacent to the ends of the respective gripping arms in which the struts 26 are engaged (see FIG. 1). Accordingly, the unitary motor mount 30 is effectively locked against longitudinal movement along the struts 26 on which it is mounted. In some cases, where it was necessary or desirable to support the motor mount 30 on the struts of greater length than the struts 26 shown in FIG. 4, clip-like locking means, preferably in the form of single-socket connector element as shown at 46 in FIG. 3, could be applied to the strut elements at one or both sides of the motor mount guide members, in order to retain the motor mount in a predetermined axial position along longer struts.

Figure 2:
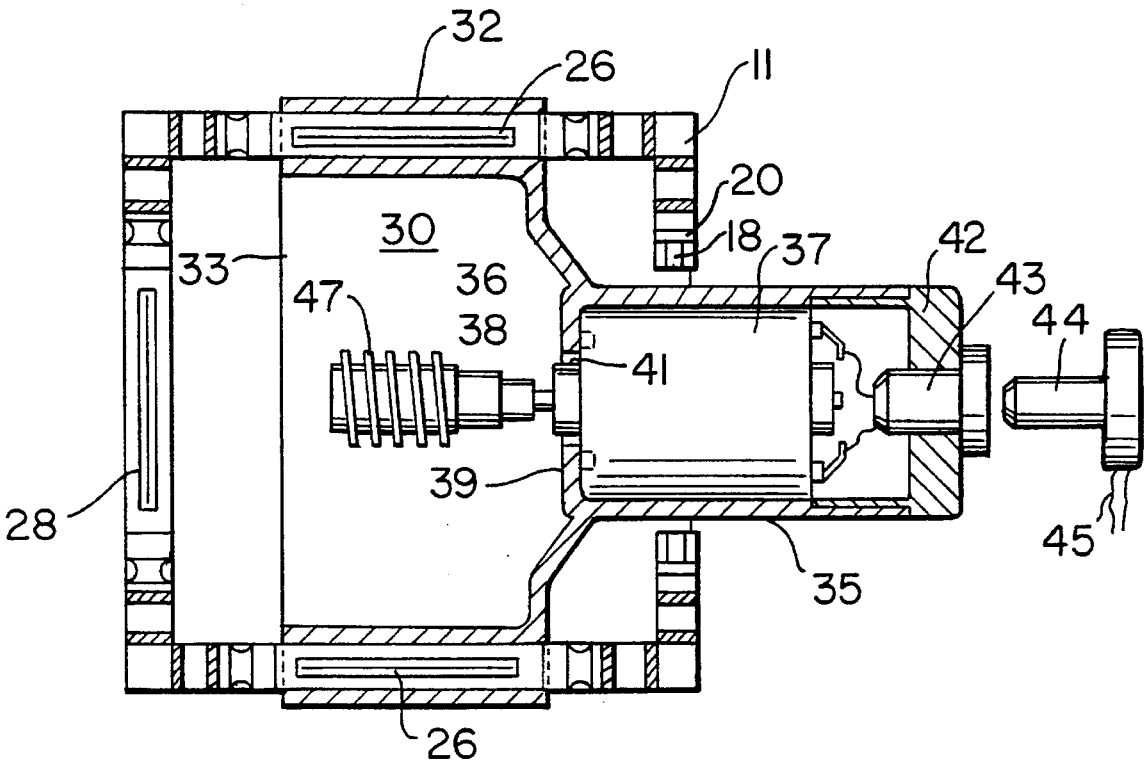
FIG. 2 is a cross sectional view as taken generally on line 2—2 of FIG. 1.

In the motor mount device of the invention, as shown in FIGS. 2 and 5, a hollow cylindrical housing 35, forming an integral part of the motor mount unit 30, is rigidly carried between the guide members 31, 32. For this purpose, portions of the motor housing are integrally associated with the structural web 33, and also with strengthening flanges 36, which extend from the guide members 31, 32 to the sidewalls of the motor housing.

The motor housing 35 is adapted to closely and snugly receive a small electrical motor 37 having an output shaft 38. The motor mount housing 35 is provided with a generally closed end 39 and an open end 40. The motor 37 is inserted through the open end 40 of the housing, and its shaft 38 is allowed to project through a central opening 41 provided in the otherwise closed end of the housing. Desirably, a cylindrical closure cap 42 is provided, which is telescopically received within the open end of the housing 35 to completely enclose and seal the motor 37. To advantage, an electrical socket 43 (FIG. 2) may be provided in the housing cap 42 to provide electrical connection to the motor 37 within. A detachable plug 44, with connections 45 to a suitable power source (e.g., 12 volts) is provided for establishing a power connection to the motor 37. Typically, a suitable control (not shown) is provided to enable off-on and reversing control as well as variable speed.

Figure 3:
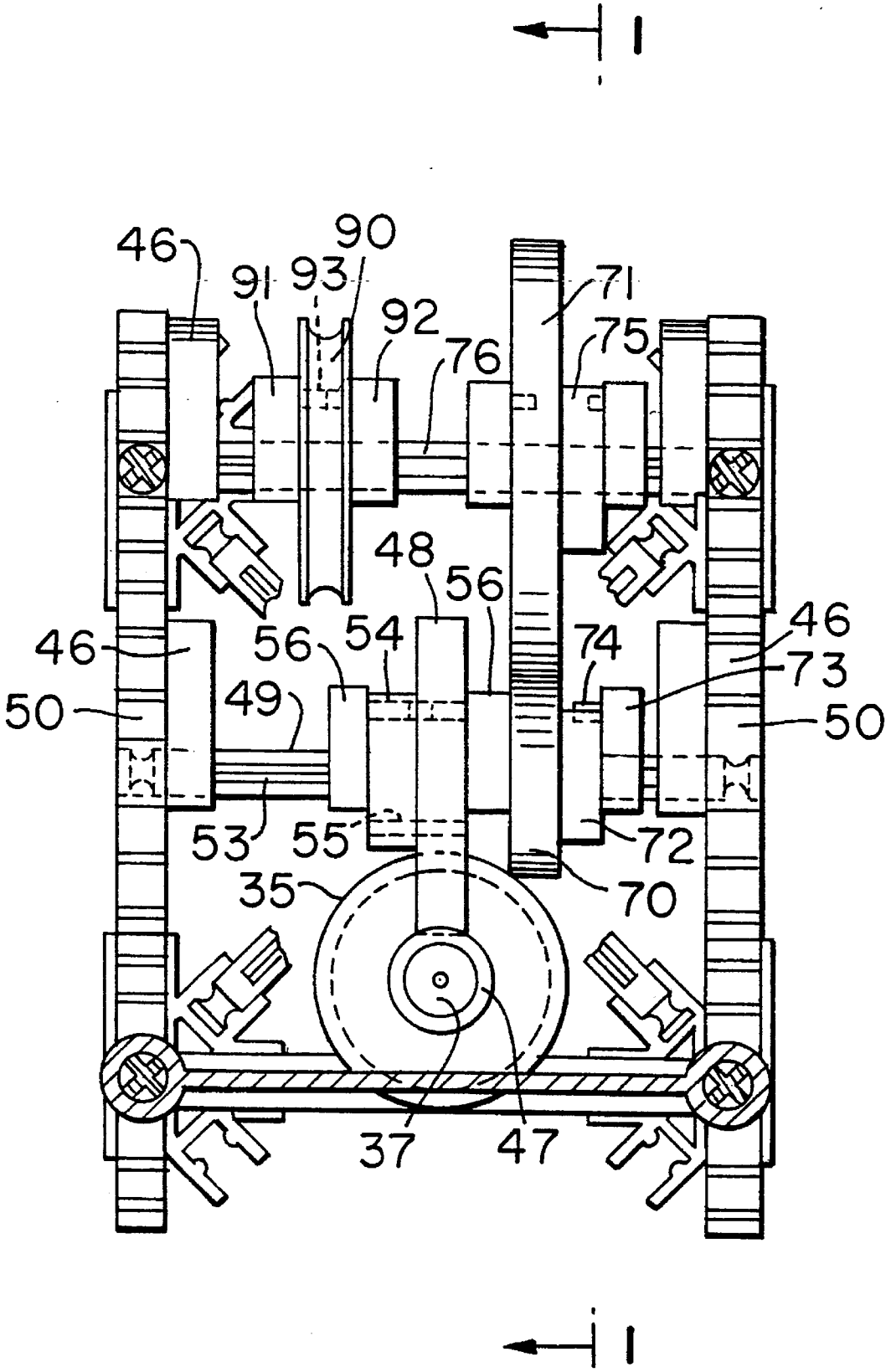
FIG. 3 is a cross sectional view as taken generally on line 3—3 of FIG. 1.

As shown particularly in FIGS. 1–3, the output shaft 38 of the motor is provided with a driving gear 47, most advantageously a worm. A worm gear 48, arranged to mesh with the worm 47, is mounted in the assembled coherent structure by means of a "shaft" 49, which is in fact one of the standard strut elements of the construction toy system. With reference to FIG. 4, the structure includes a pair of opposed, centrally mounted, eight-position connector elements 50, which are supported from each of four corner connector assemblies 11, by means of standard strut elements 51. Desirably, in a length progression of standard strut elements in the construction toy system, the elements 30, shown in FIG. 4, are the shortest. The elements 51 are of the next greater size, and it will be evident in FIG. 4 that the elements 51 are of appropriate length to form the hypotenuse side of an isosceles right triangle structure including the shortest strut elements 30 as the base sides. The strut elements 25, forming the vertical connections between upper and lower connector assemblies 11 are of the next longer size in the progression, and serve as the hypotenuse side of an isosceles right triangle in which the connector elements 51 form the base sides. These relationships are evident in FIG. 4.

The connector elements 50, at each side of the structure, have a central opening 52 of a size to closely but freely receive the strut 49 for rotation. The strut 49, which can be of any length sufficient to be engaged at both ends by the spaced-apart connector elements 50, can be positioned by, for example, applying single socket connector elements 46 at each end, in such manner that the transverse ribs 20 of the socket engage and grip longitudinal grooves 53 of the strut.

The worm gear 48 also is adapted to be closely received over the strut 49 while being normally rotatable with respect thereto. The worm gear is formed with a stabilizing and driving hub 54 and has a pair of longitudinal bores 55 extending through both the gear and the driving hub at a predetermined distance from the axis of the worm gear.

For positioning the worm gear, and drivingly connecting it to the strut 49, driving blocks 56 are provided, the configuration of which is shown in FIGS. 9 and 10. Referring to the last mentioned figures, the drive blocks 56 include a body portion 57 and a socket portion 58 comprising spaced-apart gripping arms 59, 60 having axial grooves 61 and transverse ribs 62, in the same manner as all of the connector elements of the system and in the same manner as, for example, illustrated in FIG. 6. The drive block 56 is adapted to be mounted with the axis of its gripping socket oriented transversely to the axis of a strut element to which it is connected, as shown particularly in FIG. 10. In applying the drive block, the gripping arms 59, 60 are resiliently forced apart, and the ribs 62 allowed to snap into the longitudinal grooves 53 of the strut. This not only locks the drive block 56 against rotation with respect to the strut, but the friction of the gripping action also holds the drive block in axial position on the strut against all but intentional movement.

A drive lug 63 extends laterally from the body 57 of the drive block and is located such as to be receivable in the bores 55 provided in the worm gear 48. Accordingly, after mounting the worm gear 48 on its strut shaft 49, drive blocks 56 are applied to the strut on opposite sides of the worm gear, pressed tightly against the opposite sides of the worm gear and located along the shaft so as to accurately align the worm gear 48 with its driving worm 47, all as shown in FIG. 3. By this means, the strut shaft 49 can be controllably rotated by means of the electric drive motor 37.

Pursuant to the invention, a set of drive gears is provided, for utilizing the output of the motor 37 in a manner that is fully integrated with the geometry of the construction toy system. The new system includes at least one size of pinion gear 70 and at least one size of spur gear 71 adapted for engagement with the pinion gear. The proportioning and sizing of the pinion and spur gears 70, 71 is significant in order, in a structure of standard struts and connector elements, that a gear drive may be assembled in which the pinion gears properly engage with the spur gears, to provide various combinations of mechanical advantage, and spur gears may engage with other spur gears as necessary or desirably to achieve a desired output. With reference particularly to FIGS. 1 and 3, a pinion gear 70, formed with an integral driving hub 72, is mounted on the strut shaft 49. Desirably, the pinion gear is designed to be received closely but freely over the strut shaft 49 and, in the illustrated drive mechanism, is positioned snugly against the outer surface of one of the drive blocks 56 associated with the worm gear 48. An additional drive block 73 is applied to the strut shaft 49 and has its drive lug 74 engaged with the driving hub 72 of the pinion. The pinion gear 70 is thus locked for rotation with the strut shaft 49 (and therefore with the worm gear 48) and also is fixed in axial position along the strut shaft 49.

The spur gear 71, which is also formed with a driving hub 75, is mounted on a strut 76, which is supported at each end for rotation in central openings 77 formed in the connector elements 29 (FIG. 4). The connector elements 29 are located directly above the eight-position connector elements 50 which support the worm gear 48 and the pinion 70. As shown in FIG. 4, the respective connectors 29, 50 are joined by a strut 30 of the shortest size, extending vertically from one connector to the other. The upper connector element 29, shown as a five-socket connector, may also be an eight-socket connector like the connector 50, as will be understood.

Pursuant to one aspect of the invention, the pinion and spur gear 70, 71 are proportioned such that the center-to-center distance, between these two gears in mesh, is exactly the same as the center-to-center distance between the connector elements 29, 50, joined by one of the short struts 30. In addition, the center-to-center distance between a pair of meshing spur gears 71 exactly equals the center-to-center distance between two connector elements joined by a strut 51 of the next larger size. Accordingly, in a coherent structure, assembled using standard struts and connector elements of the construction toy system, it is possible to assemble a complex gear drive mechanism, comprising multiple pinion and spur gear combinations, in order to achieve a desired result.

In a specific embodiment of the invention, the spur gear 71 could have a typical pitch diameter of about 2.08 inch, while the pinion gear 70 might have a pitch diameter of about 0.86, providing a total center-to-center distance between two meshing spur gears of about 2.08 inch and between a meshing spur gear and pinion of about 1.48 inch. The ratio of the pinion to the spur gear is approximately 14/34. These specific dimensions and ratios are of course exemplary only. Controlling is that a spur gear and pinion mesh properly along an axis between connecting elements joined by a strut of one size, and two spur gears mesh properly along an axis between two connector elements joined by a strut of a larger size.

As reflected in FIG. 1, the drive hub 75 for the larger spur gear 71 forms enclosed openings 80 for receiving drive lugs 63 of the drive blocks 54. In the case of the smaller diameter pinion 70, extending the drive hub 72 radially outward far enough to completely enclose openings for the drive lugs 63 could result in outermost portions of the drive hubs overlapping the tooth profile of the pinion. Accordingly, the drive hub 72 of the pinion is formed with radially outwardly facing cylindrically contoured grooves 81 which receive only the radially inner portions of the driving lug 74 of the drive block 73 (see FIGS. 1 and 3).

In the specific, representative mechanism shown in the drawing, an output element 90, in the form of a grooved pulley or the like (FIG. 3) is mounted on the strut 76. In the manner of the other elements of the drive system, the pulley 90 has a center opening adapted to closely but freely receive the strut 76, and the pulley is both positioned axially on the strut and connected for rotation therewith by means of opposed drive blocks 91, 92. The pulley is formed with a suitable axial opening to receive drive lugs 93 provided on the drive blocks.

As will be readily appreciated, instead of the output device 90, a further pinion 70, for example, could be mounted on the strut 76, for meshing with a still further spur gear (not shown) to provide yet another level of speed reduction and mechanical advantage increase. Almost any variety of gear train may be employed, including combinations of spur gears with pinions and spur gears with spur gears, provided the before described center-to-center relationships are observed.

The system of the present invention provides a novel, simplified and economical arrangement for incorporating a small drive motor into a coherent structure formed of snap-together struts and connector elements. A unitary, molded motor mount unit is formed with a pair of spaced-apart guide elements which engage a pair of spaced-apart strut elements, leaving end portions of the strut elements projecting at each end for snap-in assembly of the struts into a coherent structure formed of a plurality of connector elements and struts. Once attached, the motor mount and the struts by which it is carried become an integral part of the overall structure. Where desired, the motor mount unit could be molded with projecting corner fittings of the configuration of a strut end, such that the motor mount in effect incorporates its own strut elements. However, greater flexibility in construction is afforded where the motor mount incorporates guide elements which engage standard struts of the construction toy system.

A particularly advantageous feature of the invention is the provision of a set of drive gears, for cooperation with a motor carried by the above described motor mount, which are arranged to be incorporated in a structure of standard construction toy parts utilizing strut elements of progressively increasing sizes, with each next-larger size being appropriate to serve as a hypotenuse of a right isosceles triangle, where struts of the next smaller size form the base sides of such triangle. In this structural context, a set of pinion and spur gears is provided, in which a pinion and spur gear properly mesh when mounted in connector elements joined by a strut of one size, and a pair of spur gears properly mesh when mounted by connector elements joined by a strut of the next-larger size. The last mentioned features of the invention form the subject matter of my companion U.S. application Ser. No. 072,271, filed Jun. 3, 1993, now U.S. Pat. No. 5,346,420. The system is extraordinarily simple, but nevertheless allows for the construction of rather complex gear mechanisms, affording a variety of speeds and mechanical advantages and enabling drive systems of considerable complexity to be assembled.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In a construction toy system of the type comprising (a) a plurality of rod-like strut elements, (b) a plurality of hub-like connector elements, each having a radially spaced array of pairs of cantilever mounted gripping arms, (c) the ends of said strut elements and said pairs of gripping arms being shaped and contoured with opposed longitudinal grooves and inwardly projecting ribs on said gripping arms, and conforming cylindrical end portions and annular grooves on said strut elements, to accommodate lateral snap-in assembly of the strut ends into snugly gripped relation with said connector elements to form a coherent structure in which said strut ends are held in predetermined alignment by said gripping arms and are locked thereby against axial movement, the improvement characterized by (d) a motor mount supported in said coherent structure and including a rigid body and pairs of spaced apart support elements at each end of said body, (e) said spaced apart support elements having end portions shaped and contoured correspondingly to the end portions of said strut elements, for lateral snap-in assembly into snugly gripped relation with a plurality of pairs of gripping arms on a plurality of spaced apart connector elements, whereby said motor mount is rigidly incorporated into said coherent structure including said plurality of connector elements.

2. A construction toy system according to claim 1, further characterized by (a) said rod-like strut elements being provided in a plurality of standardized graduated lengths, (b) said pairs of spaced apart support elements being arranged in aligned, longitudinally spaced pairs at opposite sides of said rigid body, with respective support element end portions at opposite ends of said rigid body having a longitudinal spacing equal to the longitudinal spacing of corresponding end portions of a rod-like strut element of a selected one of said standardized lengths.

3. A construction toy system according to claim 1, further characterized by (a) said support elements comprising opposite end portions of a pair of spaced-apart rod-like strut elements, removably engageable with said rigid body, with said opposite end portions engaged by pairs of gripping arms of said connector elements, (b) said opposite end portions of said strut elements extending from opposite ends of said rigid body.

4. A construction toy system according to claim 3, further characterized by (a) said motor mount comprising a pair of tubular guide members and a body portion rigidly connecting said tubular guide members to each other, (b) first and second rod-like strut elements being received within said tubular guide members and having end portions projecting from the ends of said guide members for said lateral snap-in assembly with said connector elements.

5. A construction toy system according to claim 3, further characterized by (a) said first and second rod-like strut elements comprising selected ones of the strut elements constituting said coherent structure.

* * * * *